US005339953A

United States Patent [19]

Alex et al.

[11] Patent Number: 5,339,953

[45] Date of Patent: Aug. 23, 1994

[54] STAPLE BOX PROTECTOR

[76] Inventors: James W. Alex, 1234 Dedi Ave., Southlake Tahoe, Calif. 96150; Jeffrey S. Alex, 5225 W. Evans Rd., Rogue River, Oreg. 97537; Rick R. Gates, P.O. Box 777, Lawndale, Calif. 90260

[21] Appl. No.: 46,601

[22] Filed: Apr. 12, 1993

[51] Int. Cl.[5] ..... B65D 85/24

[52] U.S. Cl. ..... 206/340; 206/338; 220/318; 292/258

[58] Field of Search ..... 206/338, 340, 523; 220/315, 318, 903; 292/258, 288; 224/235, 901; 190/116

[56] References Cited

U.S. PATENT DOCUMENTS

| | | | |
|---|---|---|---|
| 2,342,671 | 2/1944 | Kilpatrick | 206/340 |
| 3,133,665 | 5/1964 | Colhouer | 220/318 |
| 3,421,679 | 1/1969 | Goldman | 206/523 |
| 3,893,725 | 7/1975 | Coulter et al. | 220/318 |
| 4,047,651 | 9/1977 | McMullen | 224/901 |
| 4,139,133 | 2/1979 | Repka | 224/901 |
| 4,545,501 | 10/1985 | DeFord | 220/318 |
| 4,928,823 | 5/1990 | Campbell | 206/340 |
| 5,029,533 | 5/1993 | Menard | 292/258 |

*Primary Examiner*—David T. Fidei
*Attorney, Agent, or Firm*—Richard L. Miller

[57] ABSTRACT

A staple box protector is provided which consists of a receptacle having a cushion foam insert with an open top to receive the staple box with a plurality of staple strips therein. A lid having a flange thereabout fits over and covers the open top of the receptacle. A fastener strap is for removably attaching the lid to the receptacle, so that the receptacle with the lid will protect the staple strips from breakage, thereby allowing the intact staple strips to be readily available for use.

3 Claims, 1 Drawing Sheet

STAPLE BOX PROTECTOR

BACKGROUND OF THE INVENTION

The instant invention relates generally to containers and more specifically it relates to a staple box protector.

Numerous containers have been provided in the prior art that are adapted to manage nails, screws, staples, tacks and similar small fastener articles. For example, U.S. Pat. Nos. 4,796,780 to Huang; 4,928,823 to Campbell and 4,953,764 to Kovacs all are illustrative of such prior art. While these units may be suitable for the particular purpose to which they address, they would not be as suitable for the purpose of the present invention as hereafter described.

SUMMARY OF THE INVENTION

A primary object of the present invention is to provide a staple box protector that will overcome the shortcomings of the prior art devices.

Another object is to provide a staple box protector in which individual staple strips in the staple box will be protected within a receptacle from breakage, so that the entire, intact staple strips are readily available for use.

An additional object is to provide a staple box protector in which a strap for securing the lid of the receptacle can also be used as a carrying handle.

A further object is to provide a staple box protector that is simple and easy to use.

A still further object is to provide a staple box protector that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
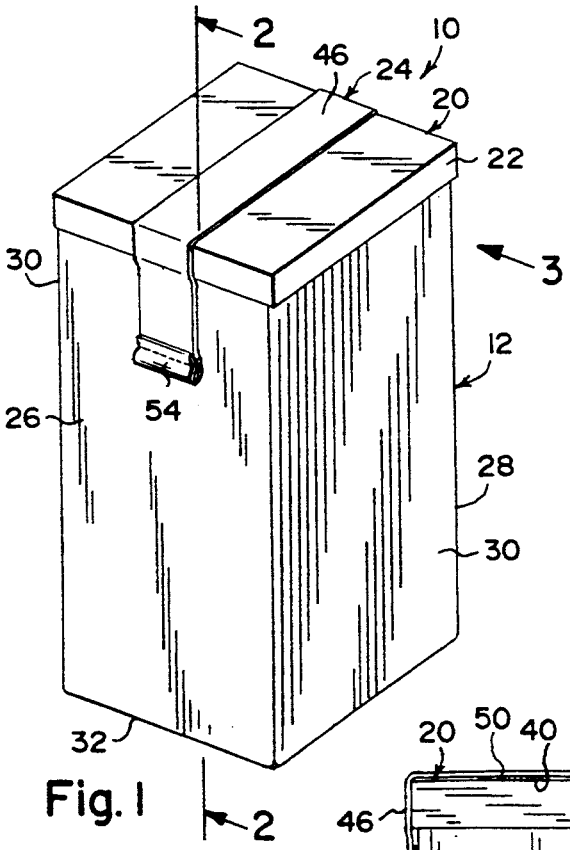
FIG. 1 is a diagrammatic perspective view of the instant invention.
Figure 2:
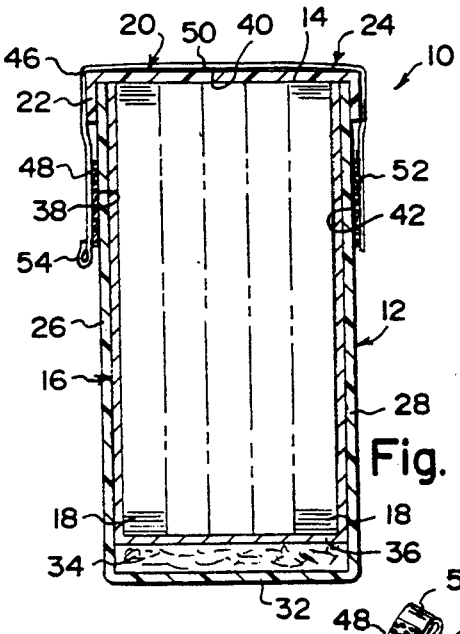
FIG. 2 is a cross sectional view taken on line 2—2 of FIG. 1.
Figure 3:
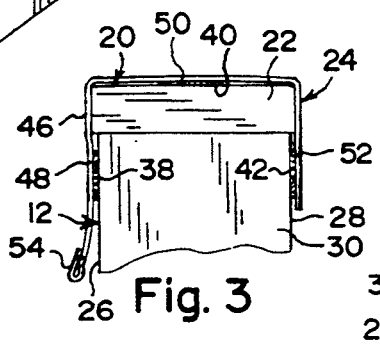
FIG. 3 is a diagrammatic side view taken in the direction of arrow 3 in FIG. 1, with parts broken away showing the strap being used for securing the lid.
Figure 5:
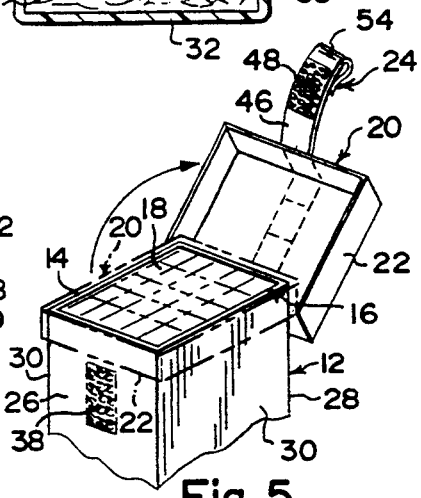
FIG. 5 is a diagrammatic perspective view with parts broken away and the lid partially removed.

Turning now descriptively to the drawings, in which similar reference characters denote similar elements throughout the several views, the Figures illustrate a staple box protector 10 which consists of a receptacle 12 having an open top 14 to receive the staple box 16 with a plurality of staple strips 18 therein. A lid 20 having a flange 22 thereabout fits over and covers the open top 14 of the receptacle 12. A device 24 is for removably attaching the lid 20 to the receptacle 12, so that the receptacle 12 with the lid 20 will protect the staple strips 18 from breakage, thereby allowing the intact staple strips 18 to be readily available for use. The receptacle 12 is generally rectangular in shape and includes a front wall 26, a rear wall 28, a pair of side walls 30 and a bottom wall 32, so that the staple box 16 can fit snugly therein. A cushion foam insert 34 is size to fit into the receptacle 12 between the bottom 36 of the staple box 16 and the bottom wall 32, to reduce impact to the stable box 16 if the receptacle 12 is dropped onto a hard surface. This helps prevent the staple strips 18 from being broken into separate pieces prior to use. It is to be noted that many stapling machines have a tendency to jam if separate pieces of broken strips 18, instead of intact strips 18, are loaded into the machine at the same loading with each other.

The removably attaching device 24 consists of three hook pile fastener material tabs 38, 40 and 42. The first tab 38 is affixed to an upper exterior surface of the front wall 26 of the receptacle 12. The second tab 40 is affixed to an exterior surface of the lid 20. The third tab 42 is affixed to an upper exterior surface of the rear wall 28 of the receptacle 12. A strap 46 has three spaced apart loop pile fastener material pads 48, 50 and 52 thereon. The first pad 48 will mate with the first tab 38, the second pad 50 will mate with the second tab 40 and the third pad 52 will mate with the third tab 42.

Figure 4:
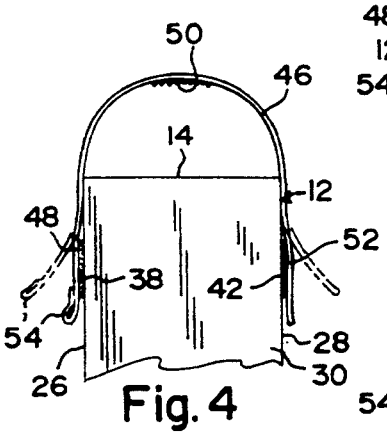
FIG. 4 is a diagrammatic side view similar to FIG. 3 showing the strap being used as a carrying handle.
Figure 6:
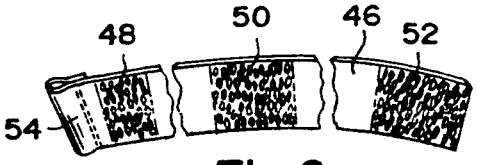
FIG. 6 is a perspective view of the underside of the strap/handle showing the position of the loop pile fastener material.
Figure 7:
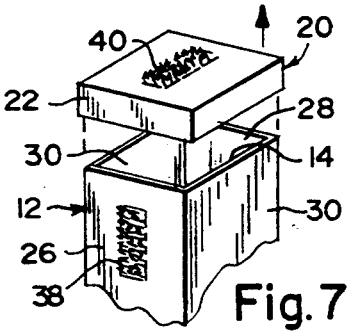
FIG. 7 is a diagrammatic perspective view with parts broken away and the lid exploded therefrom showing the placement of the hook pile fastener material.
Figure 8:
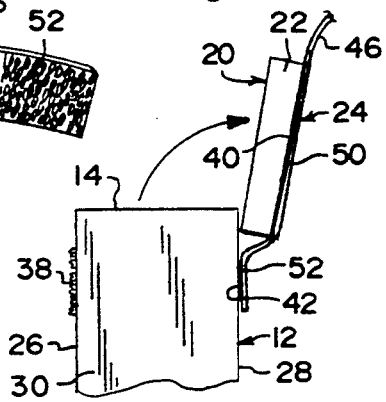
FIG. 8 is a diagrammatic side view with parts broken away showing the lid in an open position.

The strap 46 further includes a forward end folded over and stitched together to form a flap 54. The flap 54 can be pulled to release the lid 20 from the receptacle 12 and the strap 46. When the strap 46 is slackened or reattached to the receptacle 12 without the lid 20, it can be utilized as a carrying handle, as shown in FIG. 4.

To use the staple box protector 10, a person places the staple box 16 with the staple strips 18 within the 18 receptacle 12 onto the cushion foam insert 34. The lid 20 is placed over the open top 14 of the receptacle 12. The strap 24 is then removably attached to the lid 20 and the receptacle 12. When the flap 54 is pulled up the lid 20 will be flipped back, so that the staple strips 18 can be removed therefrom for use.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A staple box protector which comprises:

a) a receptacle having an open top to receive a staple box with a plurality of staple strips therein and includes a front wall, a rear wall, a pair of side walls and a bottom wall, so that the staple box can fit snugly therein;

b) a lid having a flange thereabout to fit over and cover said open top of said receptacle; and c) means for removably attaching said lid to said receptacle, so that said receptacle with said lid will protect the plurality of staple strips from breakage, thereby allowing the intact staple strips to be readily available for use, wherein said means for removably attaching said lid to said receptacle includes:

i) three hook pile fastener material tabs, in which a first tab is affixed to an upper exterior surface of said front wall of said receptacle, a second tab is affixed to an exterior surface of said lid and a third tab is affixed to an upper exterior surface of said rear wall of said receptacle; and ii) a strap having three spaced apart loop pile fastener material pads thereon, in which a first pad will mate with said first tab, a second pad will mate with said second tab and a third pad will mate with said third tab, said strap further including a forward end formed into a flap, so that said flap can be pulled to an intial extent so that the lid is flipped back and to a further extent to release said lid from said receptacle and said strap in which when said strap is reattached to said receptacle without said lid it can be utilized as a carrying handle.

2. A staple box protector as recited in claim 1, further including a cushion foam insert sized to fit into said receptacle between the bottom of the staple box and said bottom wall to reduce impact to the staple box if said receptacle is dropped onto a hard surface.

3. A staple box protector as recited in claim 2, wherein the flap is formed by folding over and stitching together the forward end of the strap.

* * * * *